United States Patent [19]

Wagner

[11] 4,018,392

[45] Apr. 19, 1977

[54] SHREDDING MACHINE

[76] Inventor: John W. Wagner, Murrysville, Pa. 15668

[22] Filed: Dec. 22, 1975

[21] Appl. No.: 643,335

[52] U.S. Cl. ..... 241/167; 83/114; 241/223; 241/236

[51] Int. Cl.[2] ..... B02C 18/14

[58] Field of Search ..... 241/166, 167, 223, 227, 241/236; 83/114

[56] References Cited

UNITED STATES PATENTS

| | | | |
|---|---|---|---|
| 1,178,386 | 4/1916 | Edwards | 83/114 |
| 2,770,302 | 11/1956 | Lee | 83/114 |
| 3,797,765 | 3/1974 | Samuels | 241/236 |
| 3,894,697 | 7/1975 | Lawson et al. | 241/236 X |

FOREIGN PATENTS OR APPLICATIONS

| | | | |
|---|---|---|---|
| 1,264,783 | 2/1972 | United Kingdom | 241/236 |

*Primary Examiner*—Roy Lake
*Assistant Examiner*—Howard N. Goldberg
*Attorney, Agent, or Firm*—Floyd S. Levison

[57] ABSTRACT

A shredding machine having a housing, a first and a second parallel spaced apart rotatably driven shafts rotatably mounted in the housing at end plates fixedly attached to the housing, driving means in the housing and operably connected to the shafts to drive the shafts counter to each other, a plurality of interfitting cutters having annular cutting surfaces disposed on the shafts and locked against rotation on the shafts by locking means, at least two support rods fixedly attached at their ends to the end plates, the support rods being parallel to each other and to the first and second shafts, a comber interposed between each of the cutters, each comber having at least two openings therethrough, one support shaft in registration with and of slightly smaller diameter than one of the openings to provide mechanical support for each comber, the first and second shafts in registration with and of slightly smaller diameter than another of the openings in each comber to provide further mechanical support for each comber, each comber free floating along the axis of the first and second shafts and the support rods to which the comber is coupled, but mechanically supported substantially perpendicular to the axis, each comber having a tongue protruding forwardly of the cutters to comb and direct the material being fed to the cutting surfaces of the cutters, the combers disposed on the first shaft having faces opposed and generally parallel to faces on the combers disposed on the second shaft, the faces defining the shredding path through the machine.

10 Claims, 2 Drawing Figures

SHREDDING MACHINE

BACKGROUND OF THE INVENTION

1. Field of the Invention

The present invention relates to shredding machines and, more particularly, to paper shredding machines which are adapted to shred high volumes of paper over extended periods of time. The present invention includes a new and novel arrangement of combers which are heavy-duty in nature and which efficiently direct and comb the material being shredded in an effective and efficient manner.

2. Description of the Prior Art

The prior art is replete with numerous forms of shredding machines and apparatus, many of which are susceptible to jamming when confronted with any substantial volume of paper to be shredded. For example, U.S. Pat. Nos. 1,178,386, 1,139,355, 1,319,496, 1,930,246, 2,202,843, 2,236,969, 2,554,114, 2,770,302, 3,033,064 and 3,797,765 are typical of the prior art patents relating to paper shredding machines. Each one of these patents attempts to improve in one form or another the performance characteristics of the shredding machine, yet fails to treat one of the basic features that has an important performance impact on the machine. This basic feature is the comber which, as the name implies, combs the material being shredded so that it efficiently is cut and moved through the shredding machine. A number of the prior art approaches include the provision of sheet metal stampings which are formed integrally with the housing. This form of comber is particularly flimsy and will become distorted and bent when there is any substantial jamming up of the paper to be shredded. Such bending of the combers can have a substantially detrimental effect on the machine in that the housing itself may become seriously damaged requiring replacement of a number of expensive parts. Furthermore, the shredding machine in question will also be disabled for a substantial period of time. Other prior art approaches include the provision of more sturdy combers which are rigidly mounted in the housing. As these machines experience an overload they will jam causing similar serious damage to the machine including the drive shafts and their supports.

DESCRIPTION OF THE INVENTION

Figure 1:
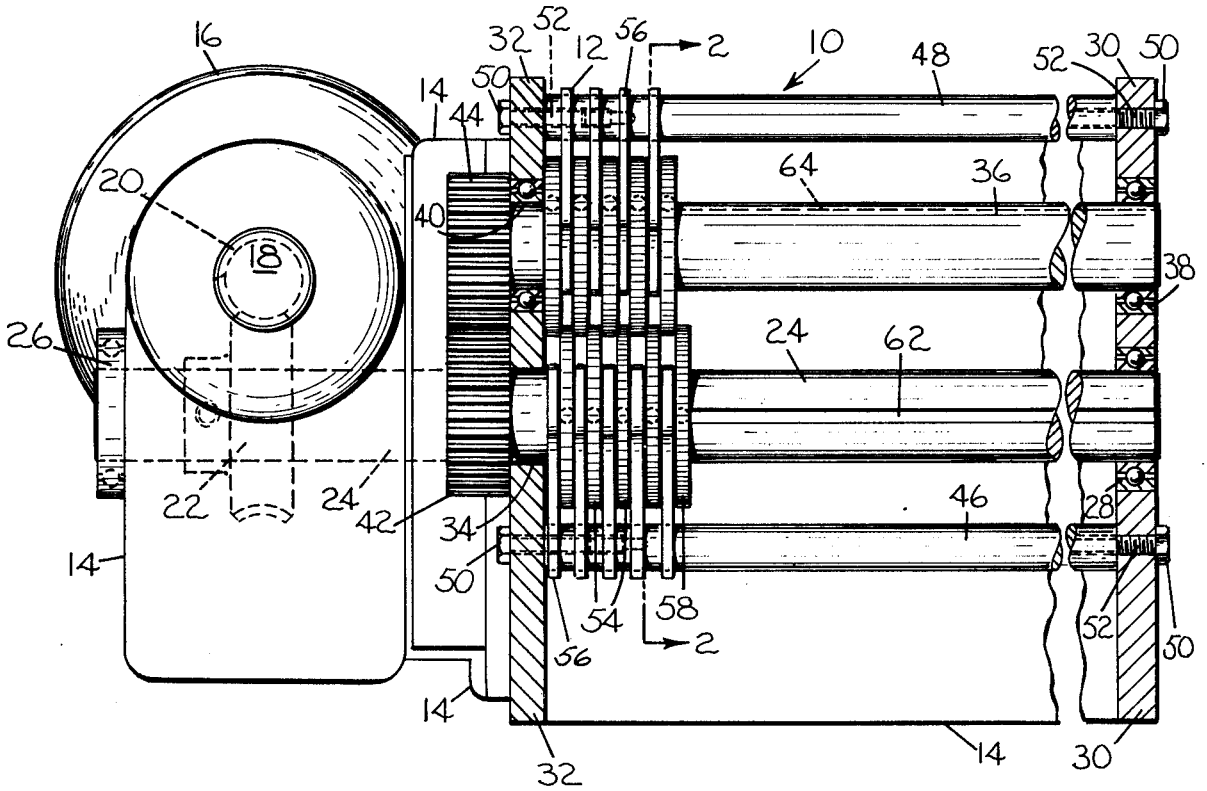
FIG. 1 is a partial cutaway view in elevation of a paper shredding machine provided with improved rugged, free floating combers in accordance with the present invention.
Figure 2:
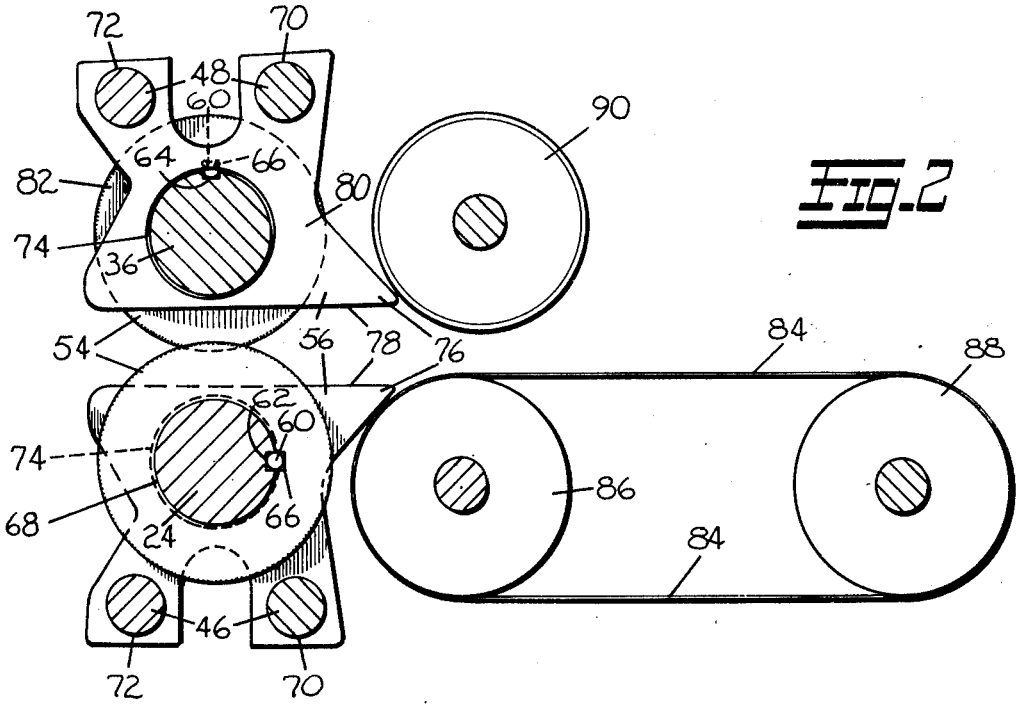
FIG. 2 is a sectional view taken along line 2—2 in FIG. 1 showing the arrangement of the combers with respect to their associated cutters, drive shafts and support rods; said FIG. 2 also includes an associated compressor or crusher roll and conveyor assembly.

Referring now to the drawings and, in particular, to FIGS. 1 and 2, there is shown an improved shredding machine 10 in accordance with the present invention. More specifically, there is shown in FIGS. 1 and 2 a paper shredding machine including combers 56 embodying the concept of my invention.

The overall layout of the improved paper shredding machine 10 which is in accordance with the present invention is best understood by referring to FIG. 1. The shredding machine 10 is provided with a housing 14 which may include a number of related parts and subassemblies.

The housing 14 includes a motor 16 suitably mounted therein to provide the operative force to drive the various components of the shredding machine 10. The motor 16 may be mounted on suitable motor mounts (not shown) and may be provided with the necessary circuitry and switches to control its speed, direction and to connect and disconnect it to line current (also not shown). The motor 16 is provided with an output shaft 18 to which a worm 20 is fixedly attached. The worm 20 is meshed with an associated worm wheel 22 disposed on a first drive shaft 24. The worm wheel 22 may be formed from the material comprising the first drive shaft 24 or may be a separate part fixedly attached thereto. The first drive shaft 24 therefore is rotatably driven by the motor 16 and said first drive shaft 24 is mounted at each end thereof in anti-friction ball bearings 26 and 28. The anti-friction ball bearing 26 is fixedly attached to the housing 14 and the anti-friction ball bearing 28 is fixedly mounted in a first end plate 30. Depending upon the overall size of the shredding machine 10, the first drive shaft 24 may be provided with an additional supporting antifrictional ball bearing intermediate its ends such as, for example, in the second end plate 32. However, the second end plate 32 as shown in FIG. 1 is not provided with an anti-friction ball bearing but it is reamed to provide a bore 34 which provides bearing support for the first drive shaft 24. The first end plate 30 and second end plate 32 are component parts of the housing 14.

A second drive shaft 36 is also rotatably mounted in the housing 14 of said machine and, more specifically, one end thereof is rotatably mounted in an anti-friction ball bearing 38 provided in said first end plate 30. A bore 40 is provided in the second end plate 32 to provide rotatable bearing support for the other end of the second drive shaft 36. The first drive shaft 24 which is circular in cross section is provided with a first spur gear 42 fixedly attached thereto and the second drive shaft 36 which is also circular in cross section is provided with a second spur gear 44 which is similarly fixedly attached thereto; the first spur gear 42 being in meshing engagement with the said second spur gear 44. It can be seen therefore at this juncture of the description of the invention that the motor 16 will drive the worm 20 through its output shaft 18; the worm 20 will, in turn, drive the worm wheel 22 formed on the first drive shaft 24 which is rotatably supported within the housing 14. As the first drive shaft 24 turns, the first spur gear 42 which is fixedly attached thereto will also turn and will drive the second spur gear 44 with which it is meshed; the second spur gear 44 will, in turn, drive the second drive shaft 36 which is also rotatably mounted in the housing 14. It can be further seen at this juncture that the first drive shaft 24 will rotate counter to the rotation of the second drive shaft 36.

The housing 14 is further provided with first and second pairs of support rods 46 and 48, each of which are fixedly attached at their respective ends to the first end plate 30 and second end plate 32 by suitable fastening means such as threaded bolts 50 in threaded engagement with threaded bores 52 provided in each end of the first and second pair of support rods 46 and 48.

The first and second drive shafts 24 and 36 and the first and second pairs of support rods 46 and 48 are all parallel to each other and are generally circular in cross section. This parallelism and circular cross section is particularly suitable for the floating operational attachment of the interfitting cutters 54 and their associated combers 56.

The cutters 54 are provided with annular cutting or shredding surfaces 58 which shred the material and, in particular, the paper being fed to the machine. The annular cutting surfaces 58 of the cutters 54 may take various forms which are generally known in the prior art. The cutters 54 are typically heat treated to render them relatively immune from wear. Each of the cutters 54 are identical and may be attached to the first drive shaft 24 and the second drive shaft 36 in a manner as set forth in my co-pending, U.S. Pat. Application Ser. No. 602,129, filed in the United States Patent Office on Aug. 5, 1975 and entitled "Shredding Machine". The cutters 54 are each locked against rotation on the first drive shaft 24 and the second drive shaft 36 by the registration of a solid spherical ball 60 in keyways 62 and 64 on the first and second drive shafts 24 and 36 respectively and in detents 66 provided in the inner surface of the bore 68 of each cutter 54. It can be seen therefore that each cutter 54 while locked against rotation on the first and second drive shafts 24 and 36 may move or float along the longitudinal axis of the first and second drive shafts 24 and 36.

The combers 56, which are all identical, are provided between each cutter 54 to form a cutter-comber array on the drive shafts 24 and 36. More specifically, and as can be clearly seen in FIG. 2, each comber is provided with a first opening 70, a second opening 72 and a third opening 74, the first and second openings 70 and 72 being identical and smaller than the third opening 74. The first and second openings 70 and 72 are circular in cross section having a diameter slightly larger than the diameter of the first and second pairs of support rods 46 and 48, and the third opening is also circular in cross section having a slightly larger diameter than the diameter of the first and second drive shafts 24 and 36. Accordingly, the combers 56 are operably assembled in the shredding machine 10 by the first and second pairs of support rods 46 and 48 being in registration with the first and second openings 70 and 72 of a comber 46 while the first and second drive shafts 24 and 36 being in registration with the third opening 74 of said comber 56. It can be seen in FIG. 1 that the assembly and disassembly of the machine is easily accomplished by the removal of the first end plate which allows access to each of the cutters 54 and combers 56 which may be then freely displaced axially. Further, it can be seen that the combers 56 are, within a limited space, free floating with respect to the first and second drive shafts 24 and 36 and with respect to the first and second pairs of support rods 46 and 48 and can move and float with the cutters 54 along the longitudinal axis of said first and second drive shafts 24 and 36. The cutters 54 are interfitting, that is, the cutters 54 on the first drive shaft are interfitted between the cutters 54 on the second drive shaft and vice versa. A comber 56 is disposed between each of the cutter 54; the lateral faces 80 of each comber may be in an abutting relationship with the lateral faces 82 of each of the cutters 54. This general abutting relationship of the combers 56 and the cutters 54 along with the coupling of the combers 56 to the first and second drive shafts 24 and 36 and to the first and second pairs of support rods 46 and 48 will maintain the generally vertical position of said combers 56 with respect to the longitudinal axis of the drive shafts 24 and 36. Accordingly, the entire cutter-comber array on each of the drive shafts 24 and 36 are free floating along the longitudinal axis thereof but are maintained generally perpendicular to said longitudinal axis. This free floating arrangement allows the cutters to be snug or closely interfitted and to self-align with respect to each other as they rotate and shred. The effect of the free floating and self-aligning is to increase the overall shredding capacity of the shredding machine 10 and at the same time reduces the probability of machine "jamming" even when the cutters 54 are confronted with a high volume of paper to be shredded. In the unlikely situation that the machine 10 does become jammed with paper, it will merely stall and no danger will occur to its various parts. All that will be required will be to switch the motor 16 to reverse to remove the jammed paper.

To further enhance the capacity and efficiency of the machine, a conveyor assembly may be provided in front of the combers to convey paper to the cutters. The conveyor which is shown in FIG. 2 is provided with a continuous belt 84 and two rollers 86 and 88, roller 86 being the front drive roller which drives the conveyor belt 84 and the roller 88 being generally a support roller for the continuous belt 84. Typically, the distance between the two rollers is approximately four feet which allows the operator of the machine to feed the machine without risk of injury or the like. The front drive roller 86 may be driven by its own drive means (not shown) or operably connected to motor 16 by suitable means such as a drive chain and sprocket arrangement (not shown). The outer cylindrical surface of the front drive roller 86 is generally tangential with the portion of the tongue 76 disposed away from the comber faces 78. To further increase the capacity and efficiency of the shredding machine 10, a compressor roll or the crusher roll 90 may be provided in a position directly over the front drive roller 86 of the conveyor. As its name implies, the compressor roll will compress and crush the material (paper) being fed into the machine. As with the front drive roller 86, the crusher roll 90 may be provided with its own drive means (not shown) or may be operably connected to the motor 16 by suitable means such as a chain and sprocket assembly (not shown). As also with the front drive roller 86, the compressor or crusher roll 90 has a cylindrical outer surface which is generally tangential with the portion of the tongue 76 disposed away from the comber faces 78.

There is thus provided a unique shredding machine including an improved free floating comber which increases the capacity and efficiency of the shredding machine and at the same time renders the machine substantially immune from damage from jamming. While a particular embodiment of the present invention has been shown and described, it will be obvious to those skilled in the art that changes or modifications may be made regarding this invention without departing from its broader aspects. Accordingly, the appended claims are to cover all such changes and modifications as they fall within the true spirit and scope of the present invention.

What is claimed is:

1. A shredding machine having a housing, a first and a second parallel spaced apart rotatably driven shafts rotatably mounted in said housing at end plates fixedly attached to said housing, driving means in said housing and operably connected to said shafts to drive said shafts counter to each other, a plurality of interfitting cutters having annular cutting surfaces disposed on said shafts and locked relative to said shafts to rotate therewith by locking means, at least two support rods fixedly attached at their ends to said end plates, said support rods being parallel to each other and to said first and second shafts, a comber interposed between each said cutters, each said comber having at least two openings therethrough, one said support rod in registration with and of slightly smaller diameter than one of said openings to provide mechanical support for each said comber, said first and second shafts in registration with and of slightly smaller diameter than another of said openings in each said comber to provide further mechanical support for each said comber, each said comber free floating along the axis of said first and second shafts and said support rods to which said comber is coupled, but mechanically supported substantially perpendicular to said axis, each said comber having a tongue protruding forwardly of said cutters to comb and direct the material being fed to said cutting surfaces of said cutters, the combers disposed on said first shaft having faces opposed and generally parallel to faces on the combers disposed on said second shaft, said faces defining the shredding path through said machine.

2. A shredding machine in accordance with claim 1 wherein there are four parallel support rods and a comber is provided with three openings therethrough.

3. A shredding machine in accordance with claim 1 wherein said shaft and support rods are circular in cross section and the openings in which said shafts and rods are in registration are complementally circular in cross section.

4. A shredding machine in accordance with claim 1 wherein each said comber is a stamped flat member having a thickness slightly less than the thickness of said cutters.

5. A shredding machine in accordance with claim 1 wherein said locking means includes axially extending keyways on the outer surface of said first and said second shafts, each said cutter having a bore therethrough for registration with said first and second shafts for mounting said cutters thereon, said cutters locked relative to said shafts to rotate therewith by the registration of a spherical ball member in said keyway and in a detent provided on the inner surface of the bores of each of said cutters.

6. A shredding machine in accordance with claim 1 wherein compacting means is provided on said housing to compact the material being fed to said cutters before said material contacts said combers.

7. A shredding machine in accordance with claim 6 wherein said compacting means includes a rotatably driven roller member whose outer cylindrical surface is substantially tangential to the portion of said tongue disposed away from said comber faces.

8. A shredding machine in accordance with claim 7 wherein conveying means is provided on said housing to convey the material to be cut to said roller members.

9. A shredding machine in accordance with claim 1 wherein the array of combers supported on said first shaft are identical to the array of combers supported by said second shaft.

10. A shredding machine in accordance with claim 1 wherein said first and said second shafts are rotatably supported in one of said end plates by anti-friction ball bearings.

* * * * *